United States Patent [19]

Duckett

[11] Patent Number: 4,828,425

[45] **Date of Patent: * May 9, 1989**

[54] PRE-LOADED HINGES FOR LANE BARRIER SYSTEM

[75] Inventor: John W. Duckett, Tiburon, Calif.

[73] Assignee: Barrier Systems, Inc., Sausalito, Calif.

[ * ] Notice: The portion of the term of this patent subsequent to Feb. 21, 2006 has been disclaimed.

[21] Appl. No.: 219,320

[22] Filed: Jul. 15, 1988

[51] Int. Cl.[4] ..... E01F 13/00; E01F 15/00

[52] U.S. Cl. ..... 404/6; 404/10; 404/12; 256/13.1; 16/285; 16/361

[58] Field of Search ..... 404/6, 9, 10, 12, 13; 256/1, 13.1; 16/285, 361

[56] References Cited

U.S. PATENT DOCUMENTS

| | | | |
|---|---|---|---|
| 2,841,059 | 7/1958 | Wiswell | 404/13 |
| 3,531,823 | 10/1970 | Cornelius | 16/361 |
| 4,105,353 | 8/1978 | Bork et al. | 404/6 X |
| 4,376,594 | 3/1983 | Prosenz | 404/6 |
| 4,435,106 | 3/1984 | Forster et al. | 404/6 |
| 4,474,503 | 10/1984 | Booth et al. | 404/6 |
| 4,496,264 | 1/1985 | Casey | 404/6 |
| 4,498,803 | 2/1985 | Quittner | 404/6 |
| 4,500,225 | 2/1985 | Quittnar | 404/13 X |
| 4,502,812 | 3/1985 | Zucker | 404/6 |
| 4,539,727 | 9/1985 | Mautner et al. | 16/285 |
| 4,547,929 | 10/1985 | Lew et al. | 16/361 X |
| 4,624,601 | 11/1986 | Quittner | 404/6 X |
| 4,661,010 | 4/1987 | Almer et al. | 404/6 |
| 4,666,332 | 5/1987 | Burgett | 404/6 |

FOREIGN PATENT DOCUMENTS

| | | | |
|---|---|---|---|
| 559969 | 7/1958 | Canada | 404/12 |
| 431594 | 8/1967 | Switzerland | 256/13.1 |

*Primary Examiner*—Jerome W. Massie, IV
*Assistant Examiner*—John F. Letchford
*Attorney, Agent, or Firm*—Phillips, Moore, Lempio & Finley

[57] ABSTRACT

A lane barrier system comprises a plurality of pivotally interconnected modules adapted to be transferred on a roadway. Each adjacent pair of modules are pivotally connected together by a hinge connection to permit the modules to elongate or contract to assume a composite varied length different from a nominal length. The controlled elongation or contraction of the lane barrier system is particularly advantageous when the barrier is positioned at various radii on a curved roadway. Each hinge connection is preloaded, such as by a torsion spring, to positively return the pivot axes of the hinge connections to their nominal positions and the lane barrier system to its nominal length when they are loaded onto a transfer machine for subsequent placement on a roadway.

20 Claims, 2 Drawing Sheets

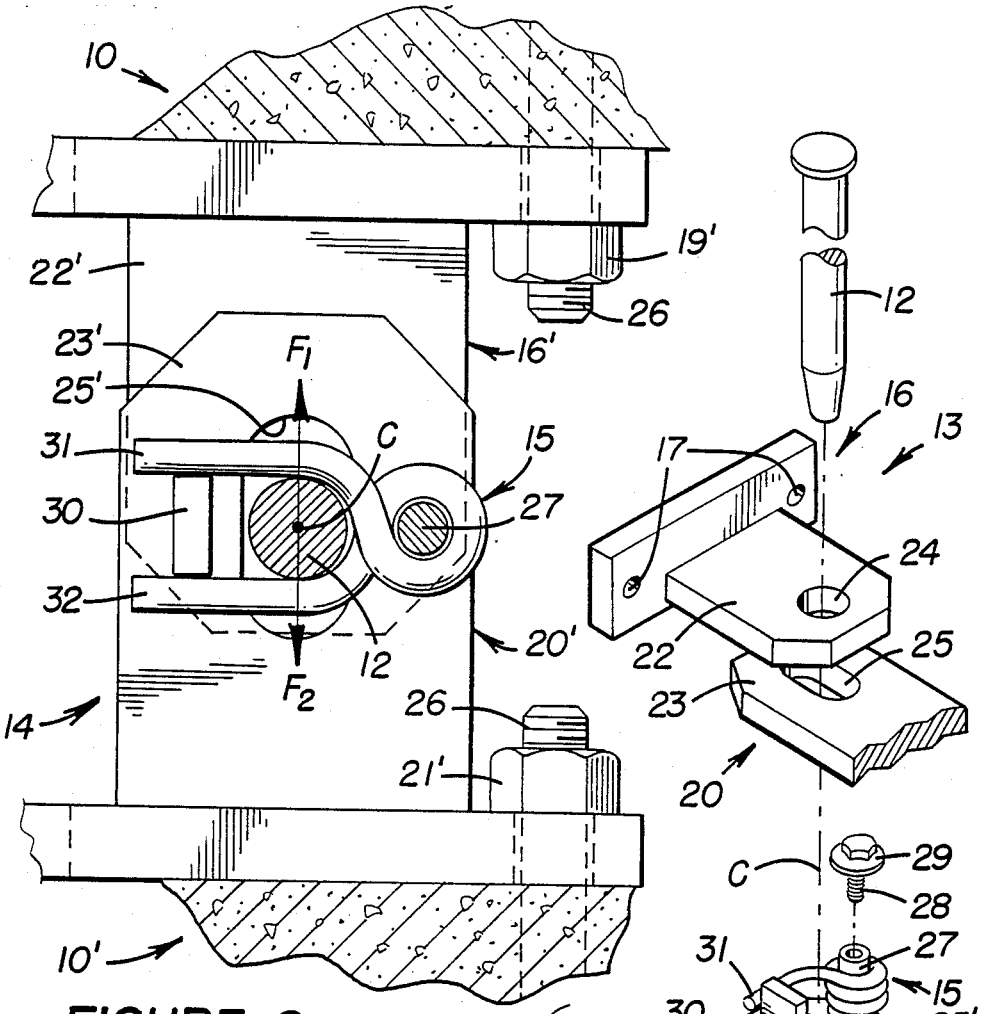
FIGURE 2
FIGURE 3
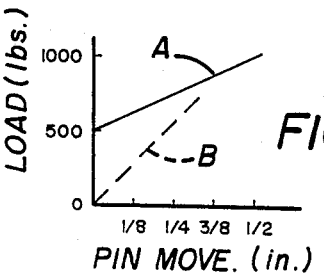
FIGURE 4

PRE-LOADED HINGES FOR LANE BARRIER SYSTEM

TECHNICAL FIELD

This invention relates to a lane barrier system for roadways and more particularly to a transferable lane barrier having a plurality of pivotally interconnected modules adapted to be lifted and moved to various locations on a roadway or the like by a transfer vehicle.

BACKGROUND OF THE INVENTION

The transferable lane barrier system disclosed in U.S. Pat. Nos. 4,498,803, 4,500,225 and 4,624,601 is adapted to be lifted by a transfer vehicle and moved to a selected position on a roadway or the like. Lane barrier systems of this type find particular application at roadway construction sites and on roadways and bridges wherein the groupings of incoming and outgoing lanes of traffic must be varied, particularly during commute hours.

As discussed in applicant's co-pending U.S. patent application Ser. No. 196,435 filed on May 20, 1988 for "Anti-Crash Lane Barrier With Self-Centering Hinges," it is advantageous to provide the system with the ability to elongate or contract to accommodate positioning of the system at varied radii on a curved roadway. For example, it has been determined that when the system is moved radially outward from a 1200 ft. radius to a 1212 ft. radius, the composite length of the lane barrier system must increase by approximately 0.25 in. for each three feet in length of the barrier system to effectively accommodate this new position on the same, curved roadway. Conversely, repositioning of the barrier system radially inwardly to a new position on the curved roadway, having a radius of curvature of 1188 ft., will require a corresponding contraction of the composite length of the lane barrier system.

The invention disclosed and claimed in the above-referenced application solves this problem by providing elastomeric pads in the hinge connections, between each pair of adjacent modules of the lane barrier system, whereby the modules will: (1) elongate or contract to assume a composite varied length different from their nominal composite length in response to the imposition of a load on the system, and (2) return the modules to their nominal composite length when the load is removed.

The invention herein constitutes an improvement over the invention covered by such application in that it was recognized by applicant that preloading of the hinges, connecting adjacent pairs of modules together, would facilitate a higher degree of uniform spacing between the modules when they are loaded onto a transfer vehicle for subsequent replacement on a roadway. In addition, when the lane barier system is placed in situ on a roadway, a greater impact force would be required to move the modules thereof to thereby increase the anti-crash capabilities of the system.

SUMMARY OF THE INVENTION

An object of this invention is to provide an improved lane barrier system for roadways and the like that overcomes the above, briefly described problems.

The lane barrier system comprises at least one pair of upstanding modules, disposed in closely spaced and tandem relationship relative to each other to normally assume a composite nominal length and nominal separation distance therebetween. The modules are pivotally connected together for relative pivotal movement about a vertical pivot axis, normally assuming a nominal position between the modules when they assume their nominal length. Preload means are provided for: (1) Imposing a predetermined first or preload load on the pivot means to force the pivot axis to its nominal position when the modules assume their nominal length; (2) Permitting the modules to elongate or contract to assume a composite varied length different from their nominal length and to move the pivot axis from its nominal position in response to the imposition of a second load on the pivot means that is greater than the first load; and (3) Automatically returning the modules to their nominal length and the pivot axis to its nominal position to re-establish the first load on the pivot means when the second load is removed.

Otherwise stated, the nominal separation distance between the modules is maintained by the first load or preload imposed thereon when the modules assume their composite nominal length with the nominal separation distance varying (becoming larger or smaller) when a greater load is imposed thereon.

In the preferred embodiment of this invention, the means connecting the modules together comprises at least one pair of overlying first and second hinge plates secured to the first and second modules, respectively, with a circular hole being formed through the first hinge plate and an elongated slot being formed through the second hinge plate in vertical alignment with the hole. A cylindrical hinge pin, having an outside diameter substantially the same as the diameter of the hole, extends through the hole and slot and preload means, such as a torsion spring, is provided for imposing the preload on the hinge pin.

This invention is particularly useful when the lane barrier system is positioned on a curved roadway and is moved from its nominal position, defined by a nominal radius, to a different radius, i.e., either radially inwardly or radially outwardly. When so moved, the composite length (arc of a near circle) of the modules will change, with their nominal length being restored automatically when the system is loaded on a transfer vehicle for replacement purposes. Further, when the system is placed on a roadway, the preloaded hinge connections will aid in rigidifying the system to increase its anti-crash capabilities.

BRIEF DESCRIPTION OF THE DRAWINGS

Other objects and advantages of this invention will become apparent from the following description and accompanying drawings wherein:

FIG. 2 is an enlarged plan view, taken in the direction of arrows II—II in FIG. 1, illustrating a preloaded hinge employed in the hinge connection;

FIG. 3 is an exploded isometric view of the hinge connection; and

FIG. 4 graphically illustrates a uniform spring constant provided by the preloaded hinge of FIG. 2 when forces are applied thereto to increase the load thereon above the preload.

DESCRIPTION OF THE PREFERRED EMBODIMENT

Figure 1:
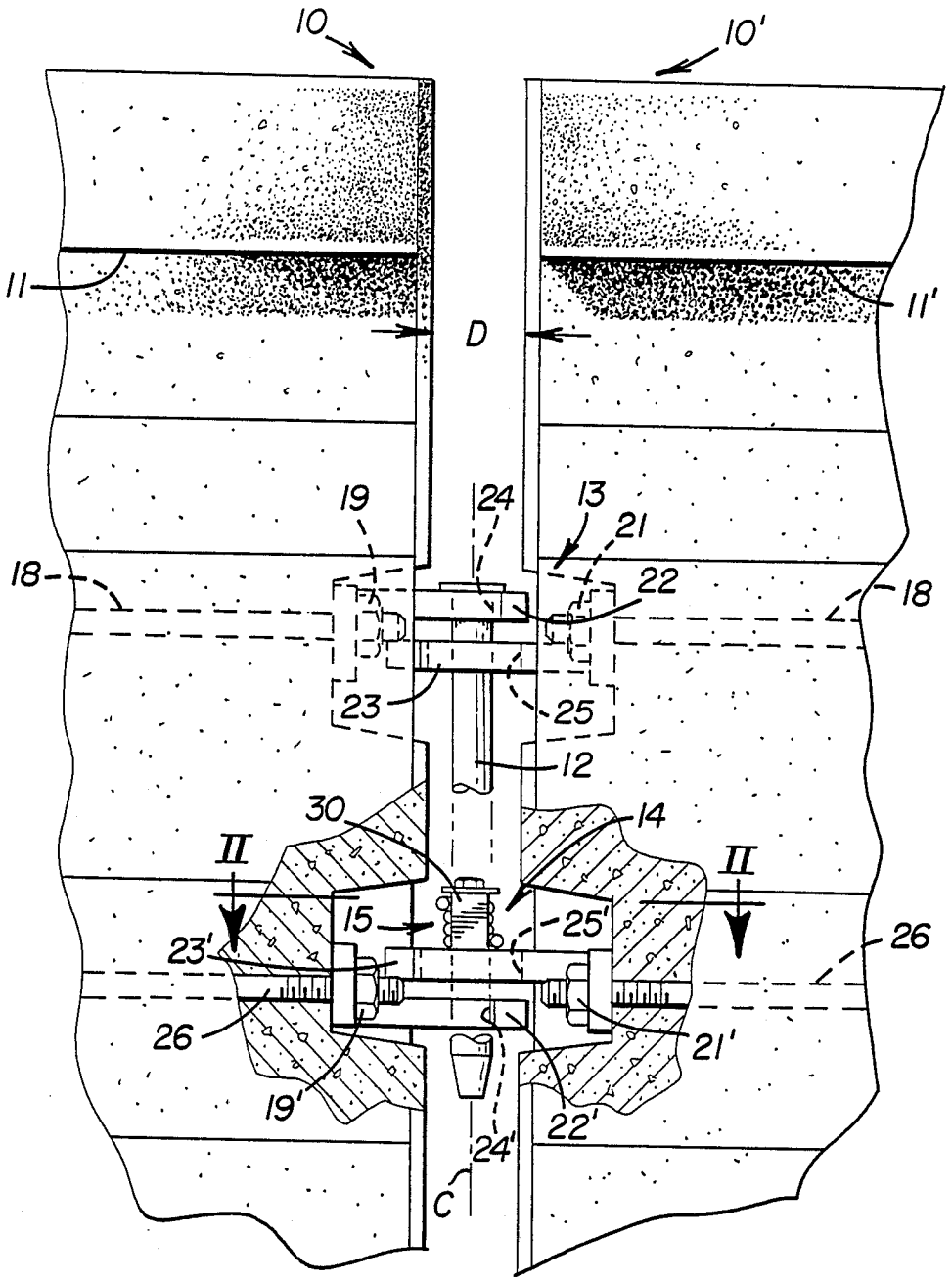
FIG. 1 is a side elevational view partially illustrating a pair of adjacent modules of a lane barrier system and a hinge connection therebetween.

FIGS. 1-3 illustrate a pair of identical and typical modules 10 and 10' adapted to form a lane barrier system of the type disclosed in above-referenced U.S. Pat. Nos. 4,498,803, 4,500,225 and 4,624,601. As described in these patents, the lane barrier system is adapted to be transferred from a first position to a laterally displaced second position at a construction site or on a roadway to delineate and provide an anti-crash carrier between lanes thereof.

In particular, a wheeled road vehicle (not shown) has a transfer mechanism mounted thereon whereby the lane barrier system can be moved in serpentine and chain-like fashion from one side of the vehicle to its other side for repositioning the system to a new location on a roadway. Since the vehicle and transfer mechanism, as well as the method for moving the system, do not form a direct part of this invention, further detailed discussions thereon are deemed unnecessary for a full understanding of this invention.

Each module 10 and 10' includes a steel reinforced concrete casting of the type described in applicant's above-referenced U.S. patent application Ser. No. 196,435. In one commercial application, each module weighs approximately 1,400 lbs. and has a height of 32.0 in., a base width of 24.0 in., a top width of 12.56 in., and a length of 37.0 in.

As further described in the above-referenced patents and application, when viewed in cross-section, each module has a T-shaped upper end defining a pair of undercut surfaces 11 on opposite sides of each module. This arrangement provides transfer means, formed in unobstructed relationship on lateral sides of each module and longitudinally throughout the entire length thereof. The aligned undercut surfaces of the modules are adapted to engage over and be lifted by rollers of a transfer mechanism of the type referenced above. The modules are hingedly connected together, as described hereinafter, to enable the modules to be lifted from a first position on a roadway, moved serpentine-like and generally transversely across the vehicle and deposited at a second location on a roadway and on the other side of the vehicle.

The hinge connection between the two illustrated modules hingedly connects them together for relative pivotal movement about a vertically disposed pivot axis C of a hinge pin 12. As described more fully hereinafter, the modules are disposed in closely spaced and tandem relationship relative to each other to normally assume a composite nominal length. The hinge connection comprises an upper hinge 13 and a lower hinge 14, aligned vertically with the upper hinge.

A torsion spring 15 is mounted in the lower hinge (or in the upper hinge or in both hinges) to provide preload means for: (1) Imposing a predetermined preload or first load (preferably within the approximate range of from 25 to 100 lbs.) on hinge pin 12 to force pivot axis C to its illustrated nominal position when the modules assume their nominal length; (2) Permitting the modules to elongate or contract to assume a composite varied length different from their nominal length and to move pivot axis C from its nominal position in the direction of the length of the system in response to the imposition of a second load on the hinge pin (depicted by arrow $F_1$ to $F_2$ in FIG. 2); and (3) Automatically return the modules to their nominal length and the pivot axis to its illustrated nominal position intermediate the modules to reestablish the preload on the hinge pin when the second, increased load is removed from the system.

Otherwise stated, the preload provided by torsion spring 15 is imposed on hinge pin 12 in the general direction of the length of the system. The preload will function to maintain a nominal separation distance D between the modules (FIG. 1) when they assume their composite nominal length and permits the modules to elongate or contract to vary such nominal separation distance in response to the imposition of a load on the hinge pin greater than the preload.

When the lane barrier system elongates and is tensioned in response to the imposition of a load thereon that is greater than the preload, as depicted by arrow $F_1$ in FIG. 2, the separation distance between the modules will widen. Conversely, when the modules contract and are compressed towards each other in response to the imposition of an oppositely directed load, greater than the preload, as depicted by arrow $F_2$, the separation distance will narrow.

The ability of the hinge connection to compensate for the relative elongation or contraction of the lane barrier system permits it to effectively assume various radii on a curved roadway. The torsion spring further functions to return the hinge pin to its nominal position illustrated in FIGS. 1 and 2 when the additional load is removed. Thus, the hinge pin will "center" between the modules automatically when the system is loaded onto a transfer vehicle to ready them for efficient placement at a new location on the roadway.

As show in FIGS. 2 and 3, upper hinge connection 13 comprises a bracket 16 having a pair of laterally spaced holes 17 formed therethrough for mounting on the threaded ends of upper tie rods 18 by nuts 19. The laterally spaced tie rods (one shown in FIGS. 1 and 2) extend longitudinally through each module with the opposite, threaded ends of the tie rods having a second bracket 20 of the upper hinge secured thereon by nuts 21.

Bracket 16 has a hinge plate 22 extending outwardly therefrom to overlie a hinge plate 23 of bracket 20. A cylindrical hole 24 is formed vertically through hinge plate 22 to normally overlie the center of an elongated slot 25, formed through hinge plate 23. The hinge pin is closely fitted within hole 24 and is allowed limited reciproaction within slot 25, upon elongation or contraction of the lane barrier system.

Lower hinge 14 includes a lower bracket 16', identical to bracket 16, having its hole 24' aligned with hole 24 of the upper bracket for reception of hinge pin 12 therethrough. The lower bracket is secured to exposed threaded ends of a pair of longitudinally extending and laterally spaced lower tie rods 26 by additional nuts 19' (FIGS. 1 and 2). The lower hinge also comprises a bracket 20' secured to the opposite, threaded ends of tie rods 26 by nuts 21'.

Bracket 20' is modified to include torsion spring 15 and attendant structures for mounting the spring in position. In particular, the coils of torsion spring 15 are mounted on a vertically disposed, cylindrical post 27. The post is secured on the upper side of hinge plate 23'. A machine screw 28, having a washer 29 mounted thereon, is threadably secured to the post to retain the torsion spring in axial position thereon.

An upstanding block 30 is welded or otherwise suitably secured on the opposite side of slot 25 with the centers of post 27 and block 30 being aligned laterally, along with pivot axis C of hinge pin 12 when the pin assumes its centered nominal position within the slot. Upper and lower ends 31 and 32 of the torsion spring extend laterally outwardly into straddling relationship relative to hinge pin 12 and block 30.

When assembling torsion spring 15 on hinge plate 23', the torsion spring is lowered onto post 27 until only lower end 32 of the spring engages a respective side of block 30. A suitable expansion tool is then applied to upper end 31 of the spring to expand it past the opposite side of the block whereby the spring can be further moved downwardly into its full mounting position on the post. The design specification for the spring (maximum outside diameter, minimum inside diameter, length, number of coils, wire size, composition, etc.) can be predetermined to construct a spring imposing the desired preload on hinge pin 12. For example, experience has shown that the outer diameter of post 27 should approximate 90% of the smallest inside diameter to which the coils of torsion spring 15 are reduced when under maximum load or travel.

When hinge pin 12 is installed, it is closely fitted within aligned holes 24 and 24' of the upper and lower hinges. Thus, center C of the hinge pin will be fixed relative to first module 10, but will be permitted to move longitudinally relative to second module 10' as dictated by the lengths of identical slots 25 and 25'. The end walls of the slots will dictate the maximum and minimum separation distances between the modules when the system elongates or contracts.

Referring to FIG. 2, the system will elongate to assume a composite length greater than its nominal length and to increase the separation distance D (FIG. 1) between the modules in response to the imposition of a load $F_1$ on hinge pin 12, greater than the preload imposed on the spring. The hinge pin will engage and expand end 31 of the spring away from block 30. Simultaneously therewith, end 32 of the spring will engage the opposite side of the block to permit such relative expansion of end 31. Conversely, imposition of a load $F_2$ on the pin, when the system contracts to reduce the separation distance between modules 10 and 10', will function to expand end 32 of the spring away from block 30 with such movement being counteracted by engagement of end 31 with the opposite side of the block.

FIG. 4 graphically illustrates a curve A, depicting a linear and uniform spring constant when preloaded torsion spring 15 is used. In this graphic example, wherein the abscissa plots the movement of hinge pin 27 in slot 25' and the ordinate plots the load imposed on the hinge pin, it is assumed that slot 25' has a length of $2\frac{1}{8}$ in. and that hinge pin 12 has an outside diameter of $1\frac{1}{8}$ in. Thus, the hinge pin is enabled to move $\frac{1}{2}$ in. within the slot in the direction of each arrow $F_1$ and $F_2$.

In FIG. 4, it is assumed that torsion spring 15 is preloaded at 500 lbs. and that it is capable of having an additional load of 500 lbs. imposed thereon before the hinge pin "bottoms-out" on one of the end walls defining slot 25'. FIG. 4 further graphically depicts a corresponding spring constant by curve B. The latter curve compares the general spring constant provided by the elastomeric pads used in the hinge connection disclosed in applicant's above-referenced U.S. patent application Ser. No. 196,435.

I claim:

1. A lane barrier system comprising at least one pair of upstanding first and second modules disposed in closely spaced and tandem relationship relative to each other to normally assume a composite nominal length, pivot means connecting said modules together for relative pivotal movement about a vertical pivot axis normally assuming a nominal position between said modules when said modules assume their nominal length, and preload means for: (1) imposing a predetermined first load on opposite sides of said pivot means to force said pivot axis to its nominal position when said modules assume their nominal length; (2) permitting said modules to elongate or contract against said first load to assume a composite varied length different from said nominal length and to move said pivot axis from its nominal position in response to the imposition of a second load, greater than said first load, on a respective one of the opposite sides of said pivot means; and (3) automatically returning said modules to their nominal length and said pivot axis to its nominal position to re-establish said first load on opposite sides of said pivot means when said second load is removed.

2. The lane barrier system of claim 1 wherein said first load is selected from the approximate range of from 25 to 100 pounds.

3. The lane barrier system of claim 1 further comprising transfer means formed on said modules for receiving and engaging a transfer apparatus to enable said module to be lifted from a first position on a roadway and deposited at a second position on said roadway.

4. The lane barrier system of claim 1 wherein said preload means comprises spring means for being expanded in response to elongation or contraction of said lane barrier system wherein said second load is imposed thereon.

5. The lane barrer system of claim 4 wherein said pivot means comprises vertically spaced upper and lower hinges and wherein said spring means is mounted in at least one of said hinges.

6. The lane barrier system of claim 4 wherein said pivot means further comprises a cylindrical hinge pin having a predetermined diameter, a first hinge plate secured to said first module and having a vertically disposed hole formed therethrough substantially conforming in diameter to said hinge pin and a second hinge plate secured to said second module in vertical alignment with said first bracket and having an elongated slot formed therethrough that is larger than the diameter of said hinge pin and wherein said hinge pin extends through said hole and said slot and said spring means is mounted on said second bracket.

7. The lane barrier system of claim 6 wherein said preload means comprises a torsion spring having coils and first and second ends straddling said hinge pin.

8. A lane barrier system of claim 7 wherein said preload means further comprises an upstanding post having the coils of said torsion spring mounted thereon, said post secured on said second hinge plate and positioned on a lateral first side of said slot.

9. The lane barrier system of claim 8 wherein said preload means further comprises an upstanding block secured on said second hinge plate in lateral alignment with said post and positioned on an opposite, second side of said slot and wherein the ends of said torsion spring straddle each of said hinge pin and said block.

10. A lane barrier system comprising at least one pair of upstanding first and second modules disposed in closely spaced and tandem relationship relative to each other to normally assume a composite nominal length, and connecting means connecting said modules together for relative pivotal movement about a vertical pivot axis and for: (1) imposing a predetermined preload on said system in opposite directions along the general direction of said length to maintain a nominal separation distance between said modules when said modules assume their composite nominal length; (2) permitting said modules to elongate or contract against said preload to assume a composite varied length different from said composite nominal length and to vary said nominal separation distance in response to the imposition of each of a compressive and tensile load, greater than said preload, on said modules and in said general direction; and (3) automatically returning said modules to their nominal length to re-establish said preload when said greater load is removed.

11. The lane barrier system of claim 10 further comprising transfer means formed on said modules for receiving and engaging a transfer apparatus to enable said module to be lifted from a first position on a roadway and deposited at a second position on said roadway.

12. The lane barrier system of claim 10 wherein said preload means comprises spring means for being expanded in response to elongation or contraction of said lane barrier system when said greater load is imposed thereon.

13. The lane barrier system of claim 12 wherein said pivot means comprises vertically spaced upper and lower hinges and wherein said spring means is mounted in at least one of said hinges.

14. The lane barrier system of claim 12 wherein said pivot means further comprises a cylindrical hinge pin having a predetermined diameter, a first hinge plate secured to said first module and having a vertically disposed hole formed therethrough substantially conforming to the diameter of said hinge pin and a second hinge plate secured to said second module in vertical alignment with said first bracket and having an elongated slot formed therethrough that is larger than the diameter of said hinge pin and wherein said hinge pin extends through said hole and said slot and said spring means is mounted on said second bracket.

15. The lane barrier system of claim 14 wherein said preload means comprises a torsion spring having coils and first and second ends straddling said hinge pin.

16. The lane barrier system of claim 15 wherein said preload means further comprises an upstanding post having the coils of said torsion spring mounted thereon, said post secured on said second hinge plate and positioned on a lateral first side of said slot.

17. The lane barrier system of claim 16 wherein said preload means further comprises an upstanding block secured on said second hinge plate in lateral alignment with said post and positioned on an opposite, second side of said slot and wherein the ends of said torsion spring straddle each of said hinge pin and said block.

18. The lane barrier system of claim 10 wherein said preload is selected from the approximate range of from 25 to 100 pounds.

19. A lane barrier system comprising at least one pair of upstanding first and second modules disposed in closely spaced and tandem relationship relative to each other to normally assume a composite nominal length, and hinge means connecting said modules together for relative pivotal movement about a vertical pivot axis comprising at least one pair of overlying first and second hinge plates secured to said first and second modules, respectively, a circular first hole formed through said first hinge plate and having its center disposed on said pivot axis, an elongated first slot formed through said second hinge plate in vertical alignment with said hole, a cylindrical hinge pin, having an outside diameter substantially the same as the diameter of said hole, extending through said hole and said slot and disposed on said pivot axis, and preload means for imposing a preload on said hinge pin to maintain said pivot axis at a nominal position between said modules and a nominal position within said slot when said modules assume their nominal length and to permit said pivot axis to shift from its nominal position when a load greater than said preload is imposed on said pin.

20. The lane barrier system of claim 19 wherein said hinge means further comprises a pair of overlying third and fourth hinge plates secured to said first and second modules, respectively, and spaced vertically relative to said first and second hinge plates, said third hinge plate having a circular second hole formed therethrough in vertical alignment with said first hole and said fourth hinge plate having an elongated second slot formed therethrough in vertical alignment with said first slot, said hinge pin further extending through said second hole and said second slot.

* * * * *